US006435506B1

(12) United States Patent
Piccoli

(10) Patent No.: US 6,435,506 B1
(45) Date of Patent: Aug. 20, 2002

(54) METHOD OF PLAYING A POKER GAME THAT IS BETTER THAN CARIBBEAN STUD POKER

(75) Inventor: John Piccoli, Las Vegas, NV (US)

(73) Assignee: JNLU, LLC, Las Vegas, NV (US)

( * ) Notice: Subject to any disclaimer, the term of this patent is extended or adjusted under 35 U.S.C. 154(b) by 0 days.

(21) Appl. No.: 09/519,628

(22) Filed: Mar. 6, 2000

(51) Int. Cl.[7] ..... A63F 1/00

(52) U.S. Cl. ..... 273/292; 273/274; 273/309; 273/85 CP; 463/13; 463/25; 463/26; 463/27

(58) Field of Search ..... 273/236, 292; 463/13

(56) References Cited

U.S. PATENT DOCUMENTS 4,836,553 A * 6/1989 Suttle et al. ..... 273/292
5,022,653 A * 6/1991 Suttle et al. ..... 273/85 CP
5,374,067 A * 12/1994 Jones ..... 273/292
5,377,973 A * 1/1995 Jones et al. ..... 273/85 C
B15,377,973 A * 12/1996 Jones et al. ..... 463/12
5,725,216 A * 3/1998 Jones ..... 273/292
5,794,964 A * 8/1998 Jones et al. ..... 273/309
5,795,225 A * 8/1998 Jones et al. ..... 463/13
5,810,354 A * 9/1998 Banyai ..... 273/292
5,836,818 A * 11/1998 Jones et al. ..... 463/29
5,913,726 A * 6/1999 Jones et al. ..... 463/13
5,921,550 A * 7/1999 Awada ..... 273/292
5,964,464 A * 10/1999 Jones ..... 273/292
6,045,130 A * 4/2000 Jones et al. ..... 273/292
6,070,878 A * 6/2000 Jones et al. ..... 273/309
6,073,930 A * 6/2000 Jones et al. ..... 273/292
6,102,402 A * 8/2000 Scott et al. ..... 273/292
6,113,101 A * 9/2000 Wirth ..... 273/274
6,131,907 A * 10/2000 Nucifora et al. ..... 273/292
6,206,373 B1 * 3/2001 Garrod ..... 273/292
6,234,895 B1 * 5/2001 Jones et al. ..... 463/13

* cited by examiner

*Primary Examiner*—Benjamin H. Layno
*Assistant Examiner*—Delores R Collins
(74) *Attorney, Agent, or Firm*—Harry M. Weiss; Jeffrey Weiss; Weiss & Moy, P.C.

(57) ABSTRACT

A method for playing an improved version of Caribbean Stud poker is disclosed which includes providing any player playing against a dealer an option to bet an additional amount only equal to the player's Ante bet after receipt of the player's five cards; and paying any player playing against the dealer who has bet the same additional amount as the Ante bet a bonus payout of multiple times the additional bet amount according to a pre-set bonus payout schedule for the player receiving a hand having a poker value from two pair to a Royal Flush regardless of whether or not the dealer qualified with a five card hand of an Ace and a King or better and provided that the dealer's hand if it qualifies is not better than the player's hand that would have qualified for the bonus payout.

7 Claims, No Drawings

METHOD OF PLAYING A POKER GAME THAT IS BETTER THAN CARIBBEAN STUD POKER

FIELD OF THE INVENTION

This invention generally relates to methods for playing poker games that provide pay-backs to poker players and, more particularly, relates to a method for playing a poker game that is an improvement to the Caribbean Stud poker game.

BACKGROUND OF THE PRIOR ART

In the past, various poker games have been created for people desiring to play poker. Generally speaking, there are two types of poker games—one type or class is playing to win against other players while the other type or class is playing to win against the dealer.

For the type or class in playing against other players, commonly known poker games comprise five card draw poker, five card stud poker, seven card stud poker, Texas Holdem, Omaha, etc. These poker games have different rules and also variations thereof which may include the use of wild cards, jokers, etc. Some of these poker games provide for high and low hand winners.

For the type or class in playing against the dealer, various poker games have been created such as Caribbean Stud poker. Caribbean Stud poker has become a very popular poker game because of the opportunity to win by obtaining a poker hand better than the dealer's poker hand and also having the possibility of receiving a large bonus or jackpot type payout for obtaining a poker hand that meets one of the jackpot type hands such as a flush (five cards of the same suit i.e. spades, hearts, diamonds or clubs), a full house (three cards of the same rank plus a pair of a different rank i.e. three nines and two jacks, etc.), four of a kind four cards of the same rank plus a fifth card i.e. four kings plus a five, etc.), a straight flush (five cards of the same suit in consecutive order i.e. 4,5,6,7 and 8 all of spades, etc.) and a royal flush (the highest five cards of the same suit in consecutive-order i.e. ten, jack, queen, king and ace of hearts etc.). The jackpot payout is enlarged when each Caribbean Stud game is tied into a progressive jackpot network.

Caribbean Stud poker is presently played in the following manner:

Each player at a single table playing against a single dealer is dealt, in order, together with the dealer five separate (face down for each player) playing cards out of a standard deck of 52 playing cards. The dealer's last card is dealt face up thereby providing the players at the table some indication of the dealer's five card poker hand because 20% of the dealer's poker hand is exposed to view.

Each player, prior to receiving their five playing cards must place a bet (in an amount determined by each casino for the Caribbean Stud poker game) in order to be in the game and thereby receive their five playing cards. For example, a $5 chip is often used as the minimum bet to qualify each player to receive their five playing cards. This chip is placed in a designated region on the table in front of each player which is usually designated as the Ante. If desired, any player can increase the bet to be placed as an Ante bet to the limit that is generally pre-set by the casino operating the Caribbean Stud game for the Ante bet. The importance of the amount of the Ante bet becomes more significant after each player that has placed their Ante bet is dealt their five playing cards.

Prior to each player receiving their five playing cards and after placing the Ante bet to be in the Caribbean Stud game, each player has the option of placing, for example, a one (casino) dollar coin in a slot in front of the Ante region in order to be eligible to receive the progressive bonus jackpot amount for a, for example, Royal Flush poker hand.

This optional one dollar bet to be eligible to receive the progressive bonus jackpot is usually signaled by a (red) light adjacent to the slot thereby alerting the dealer-that that player is eligible to receive the progressive bonus jackpot if the player receives the progressive bonus jackpot five card hand. However, if the player elects not to insert the one dollar coin into the slot, then that player cannot be eligible to receive the progressive bonus jackpot amount even if, for example, that player actually receives the designated progressive bonus jackpot five card poker hand.

After the Ante bet is made by each player at the table and after the election is made to either bet the one dollar to be eligible for the progressive bonus jackpot hand or not bet the one dollar to not be eligible for the progressive bonus jackpot hand, the five playing cards are dealt to each player and to the dealer in consecutive order as set forth above.

Each player now has the present option of either folding or giving up their five playing card hand which means that they will surrender their Ante bet to the dealer or doubling the Ante bet by placing the doubled (Ante) bet in a region on the table in front of the player which is usually designated as the Bet region. Thus, for example, if a five dollar chip is placed in the Ante region, then ten dollars worth of chips has to be bet or placed in the Bet region in order to qualify (this is the second qualification step) the player to contest the dealer's hand. This Bet wager or action by each player serves to "call" the dealer's hand.

After each player has declared his or her intentions on either forfeiting the Ante bet to the dealer or placing the double the Ante bet in the Bet region, then the dealer turns over the dealer's other four cards (which were previously face down in front of the dealer adjacent the one face up card previously exposed by the dealer). At this time, the dealer is required to determine if the dealer's five total cards have a minimum high hand value of at least an Ace and a King or better. This term, "better" means that the dealer's hand will have at least a pair (any too cards of the same value i.e. a pair of tens, etc.), two pair, three of a kind, a straight, a flush, a full house, four of a kind, a straight flush or a Royal Flush which are all better hands than the minimum hand of an Ace and a King that the dealer is required to have to continue play with the players at the dealer's table.

In the event that the dealer's hand does not have the minimum Ace and King hand, then those players who have made both the Ante bet and the double-the-Ante bet in the Bet region will receive both a sum equal to the Ante bet plus their own Ante Bet, however, the double-the-Ante bet in the Bet region will be returned or refunded to each of the players who have made such a bet.

In the other event where the dealer's hand has the minimum Ace and King or better, then there is a contest or comparison between each player's hand and the dealer's hand. If the dealer's hand is better than any player's hand, then that player loses both the Ante bet and the double-the-Ante bet. However, if the dealer's qualified (Ace and King or better) hand is worse than a player's hand, then that player receives back from the dealer the Ante bet plus an amount equal to the Ante bet and also the return of the double-the-Ante bet in the Bet region plus a bonus amount that is paid in accordance with, for example, the following schedule or list: the same amount as the double-the-Ante bet amount if the player's hand is between an Ace and King minimum hand and (including) one pair, two times the double-the-Ante bet amount if the player's hand has two pair, three times the double-the-Ante bet amount if the player's hand has three of a kind, four times the double-the-Ante bet amount if the player's hand is a straight, five times the double-the-Ante bet amount if the player's hand is a flush, seven times the double-the-Ante bet amount if the player's hand is a full house, twenty times the double-the-Ante bet amount it the player's hand is a four of a kind type hand, fifty times the double-the-Ante bet amount if the player's hand is a straight flush, and one hundred times the double-the-Ante bet amount if the player's hand is a Royal Flush. This is one schedule al payouts and other schedules can be used, if desired. Only in the rare event of the dealer and the player having the same effective card value hand is there a draw or "push" and the player receives back the Ante bet and the double-the-Ante bet and nothing else.

As can be seen from the above description of play, the player playing against the dealer can be deprived of a significant amount of money if the player has a great hand, but the dealer hasn't qualified for play because the dealer lacks the minimum Ace and King or better hand.

The only consolation that a Caribbean Stud player has is to have previously placed the (optional) one dollar bet to qualify for a progressive jackpot award. In this situation, the player will receive a jackpot type award if that player receives one of the following poker hands: 100 percent of the progressive jackpot amount if the player has a Royal Flush, ten percent of the progressive jackpot amount if the player has a straight flush, one hundred dollars if the player has a four of a kind type hand, seventy-five dollars it the player has a full house and fifty dollars if the player has a flush. This schedule of payouts can be changed, if desired.

Thus, the present game of Caribbean Stud has a certain feature or aspect thereto that is very annoying to all the players playing this game against the dealer. A present fundamental requirement of the present Caribbean Stud poker game is that each of the players (this can be as many as seven players per table) playing against the single dealer at the table can receive a very good poker hand, but yet be deprived of a significant amount of money because the dealer did not have a qualifying (Ace and King o)r better) poker hand. The following is a listing of U.S. Patents that are allegedly related to the Caribbean Stud poker game: U.S. Pat. Nos. 4,836,553; 4861,041; 4,948,134; 5,022,653; 5,078,405; 5,112,060, 5,288,077; 5,364,104;5,364,105; 5,374,067; 5,377,973; 5,377,994; 5,380,012; 5,382,025; 5,542,438; 5,544,893; 5,577,731; 5,584,485; 5,626,341; 5,725,216; 5,743,798; 5,794,964; 5,795,225; D311,474; D373,217.

The prior attempt to pacify players originally playing Caribbean Stud poker who felt deprived when they had a very good poker hand, but couldn't collect because the dealer didn't receive a qualifying hand (Ace and King or Better), became a version of Caribbean Stud which was introduced or known as "BAHAMA BONUS" which provided the one dollar bonus discussed above that became incorporated into the current version of the Caribbean Stud poker game.

Other attempts to create a better version of Caribbean Stud have been tried, but none have been creative enough to provide an improved Caribbean Stud poker game version that will accomplish the mutual goals of providing a fair return to the house or casino and a significant payback to the player receiving a good poker hand even though the dealer did not qualify (Ace and King or better) and there was no one dollar bet made to qualify for the bonus jackpot. As explained above, the one dollar bet only permitted the player to qualify for certain pre-selected jackpot bonus poker hands.

Therefore, a need existed to provide an improved Caribbean Stud poker game that gave a player a chance at receiving a payback for a good poker hand regardless of whether or not the dealer qualified (Ace and King or better) and regardless of whether the one dollar was bet to qualify for the progressive bonus jackpot.

SUMMARY OF THE INVENTION

It is an object of this invention to provide an improved method of playing a poker game that is better than the present Caribbean Stud Poker game.

It is a further object of this invention to provide an improved version of the Caribbean Stud poker game that will provide a return for each player if they receive a very good poker hand regardless of whether or not the dealer receives the minimum Ace and King or better poker hand.

It is a still further object of this invention to provide an improved version of the Caribbean Stud poker game that will provide a return for each player if they receive a very good poker hand regardless of whether or not the dealer receives the minimum Ace and King or better poker hand and without having to bet a dollar for the possible receipt of a bonus hand under a progressive bonus payout schedule.

BRIEF DESCRIPTION OF THE PREFERRED EMBODIMENTS

Accordingly, a method is disclosed for improving Caribbean Stud poker comprising the steps of: providing any player playing against a dealer an option to bet an additional amount only equal to the player's Ante bet after receipt of the player's five cards; and paying any player playing against the dealer-who has bet the same additional amount as the Ante bet a bonus payout of multiple times the additional bet amount according to a pre-set bonus payout schedule for the player receiving a hand having a poker value from two pair to a Royal Flush regardless of whether or not the dealer qualified with a five card hand of an Ace and a King or better and provided that the dealer's hand if it qualifies is not better than the player's hand that would have qualified for the bonus payout.

The foregoing and other objects, features and advantages of this invention will be apparent from the following more particular description of the preferred embodiments of the inventor as illustrated in the accompanying drawings.

DESCRIPTION OF THE SPECIFICATION

The method of this invention to provide an improved version of the present Caribbean Stud poker game uses certain steps or features of the present Caribbean Stud poker game which includes the one dollar bonus bet for qualifying for a possible progressive bonus jackpot payout, making an Ante bet, optionally either folding a player's poker hand and forfeiting the Ante bet to the dealer or playing the player's hand against the dealer's hand.

However, the major significant difference which, in combination, is considered to be a patentable improvement in the method of playing this disclosed version of Caribbean Stud poker is that there is a payback to the player if the player receives a good poker hand even if the dealer's five card poker hand does not qualify (contain the Ace and King or better playing cards). This significant difference avoids the frustrations ink despair of a player who receives a good poker hand, but can't qualify for a bonus payout because the dealer's hand didn't qualify with an Ace and King or better.

Also, the major significant difference of the method of this invention is to provide a bonus type payout regardless of whether or not the player has bet the one dollar to qualify for the progressive jackpot.

This bonus payback to each player is achieved or, created when the player options to place a bet in the Bet region that is the same amount as the Ante bet that was previously placed to receive the five cards from the dealer. Thus, this additional bet amount which is the same amount as the Ante bet and which is done after the player receives and reviews the five cards that the player obtains from the dealer, qualifies the player to be eligible for a bonus payment amount as set forth in the following bonus pay table:

| HAND | PAY TABLE A |
|---|---|
| Royal Flush | 250:1 |
| Straight Flush | 100:1 |
| 4 of a Kind | 25:1 |
| Full House | 10:1 |
| Flush | 7:1 |
| Straight | 5:1 |
| 3 of a Kind | 4:1 |
| Two Pair | 2:1 |
| One Pair | 1:1 |
| A + K High | 1:1 |

Note that if both the player and the dealer fail to qualify or if the player and dealer have equal qualifying poker hands it is a push with no money changing hands.

It should be understood that the above noted multiple payout amounts for a player's bonus hand can be varied, if desired.

Accordingly, regardless of whether the dealer qualifies with an Ace and King or better hand, the player is eligible to receive a bonus pay amount for a hand that is one of the hands set forth in the above table provided that the dealer's hand, if it is in fact a qualifying hand (Ace and King or Better), is not a better poker hand than the hand of the player even if the hand of the player is one of the hands noted in the bonus pay table.

In this manner, the frustrations of a Caribbean Stud player receiving a very good poker hand are substantially eliminated when the player places the separate bet amount equal to the Ante bet and thereby qualifies to receive the bonus pay amount noted in the above bonus pay table regardless of whether or not the dealer qualifies with an Ace and King or better hand provided however that the player's bonus payout hand is still better than the dealer's hand for the condition where the dealer has a qualifying hand of an Ace and King or better.

The remaining rules of Caribbean Stud also apply to this version of Caribbean Stud other than the above noted differences. Hence, the player can be eligible to receive the progressive bonus jackpot amount if the player bets the one dollar amount to qualify for this bonus jackpot payout, etc. The player still receives both the return of the Ante bet amount plus the call bet and an amount equal to one of the bonus designated payments even if the dealer does not have a qualifying hand.

Other possible bonus payout amounts are noted below which can be used instead of the bonus payout amount shown in the above table.

| Hand | Pay Table B | Pay Table C |
|---|---|---|
| Royal Flush | 500:1 | 200:1 |
| Straight Flush | 100:1 | 50:1 |
| 4 of a Kind | 25:1 | 25:1 |
| Full House | 10:1 | 12:1 |
| Flush | 7:1 | 9:1 |
| Straight | 5:1 | 6:1 |
| 3 of a Kind | 4:1 | 3:1 |
| Two Pair | 2:1 | 2:1 |
| One Pair | 1:1 | 1:1 |
| A + K High | 1:1 | 1:1 |

As noted above if the dealer does not qualify, each player who called will be paid the player's call bet or additional bet according to the Bonus pay table below and the player's Ante bet is returned.

If the dealer has qualified, the dealer will compare the dealer's hand with each of the players' hands. In each case—player against the dealer—whoever has the stronger hand wins.

The player:

either loses both the Ante and call wagers if the dealer's hand outranks the player's hand, or wins even money on the Ante wager plus a bonus paid on the additional or call wager if the player's hand outranks the dealer's qualified hand.

In summary, mathematical analysis using a computer was undertaken of the different above noted bonus payout hands to determine whether the casino would have a reasonable, but not excessive payback from players playing this improved version of Caribbean Stud poker. The casino or house has a calculated advantage depending upon which of the above three sets of bonus payouts are used ranging from a low of 3.57% to an intermediate (first large table) level of 3.61% to a high of 4.69% (for the last table) for the Ante bet that is wagered by each player. The corresponding house or casino advantage per bet unit is correspondingly 2.28%, 2.31% and 3.00%.

Therefore, this mathematical analysis establishes the reasonableness and desirability to both the player and the house or casino for playing this improved version of Caribbean Stud poker that substantially overcomes the frustrations of a player playing the previous version of Caribbean Stud poker when the dealer did not receive a qualifying hand.

While the invention has been particularly shown and described with reference to the preferred embodiments thereof, it will be understood by those skilled in the art that the foregoing and other changes in form and details may be made therein without departing from the spirit and scope of the invention.

I claim:

1. A method for improving Caribbean Stud poker comprising the steps of:

providing any Caribbean Stud poker player playing against a Caribbean Stud poker dealer an option to bet an additional amount only equal to the player's Caribbean Stud poker Ante bet after receipt of the player's five cards in a Caribbean Stud poker game to provide the player an opportunity to receive a bonus payout of multiple times the additional amount bet by the player regardless of whether or not the Caribbean Stud poker dealer qualified with a five card Caribbean Stud poker hand of an Ace and a King or better; and paying any Caribbean Stud poker player playing against the Caribbean Stud poker dealer who has bet the same additional amount as the Caribbean Stud poker Ante bet a bonus payout of multiple times the additional bet amount according to a pre-set bonus payout schedule for the player receiving a hand having a poker value from two pair to a Royal Flush regardless of whether or not the Caribbean Stud poker dealer qualified with a five card Caribbean Stud poker hand of an Ace and a King or better and provided that the Caribbean Stud poker dealer's hand if it qualifies is not better than the Caribbean Stud poker player's hand that has qualified for the bonus payout.

2. The method of claim 1 including the step of paying the Caribbean Stud poker player making the additional bet a sum equal to the additional bet if the Caribbean Stud poker player receives a five card Caribbean Stud poker hand equal to an Ace and King up to and including a single pair.

3. The method of claim 1 including also providing every Caribbean Stud poker player playing against the Caribbean Stud poker dealer an opportunity to bet one dollar to be eligible for a Caribbean Stud poker progressive bonus jackpot payout prior to receiving any cards from the Caribbean Stud poker dealer.

4. The method of claim 1 wherein the Caribbean Stud poker player's bonus payout is in accordance with the following Caribbean Stud poker bonus payout schedule: two times the additional amount for a Caribbean Stud poker hand having a value of two pair, four times the additional amount for a Caribbean Stud poker hand having a value of three of a kind, five times the additional amount for a Caribbean Stud poker hand having a value of a straight, seven times the additional amount for a Caribbean Stud poker hand having a value of a flush, ten times the additional amount for a Caribbean Stud poker hand having a value of a full house, twenty five times the additional amount for a Caribbean Stud poker hand having a value of four of a kind, one hundred times the additional amount for a Caribbean Stud poker hand having the value of a straight flush and two hundred and fifty times the additional amount for a Caribbean Stud poker hand having the value of a Royal Flush.

5. The method of claim 2 wherein the Caribbean Stud poker player's bonus payout is in accordance with the following Caribbean Stud poker bonus payout schedule: two times the additional amount for a Caribbean Stud poker hand having a value of two pair, four times the additional amount for a Caribbean Stud poker hand having a value of three of a kind, five times the additional amount for a Caribbean Stud poker hand having a value of a straight, seven times the additional amount for a Caribbean Stud poker hand having a value of a flush, ten times the additional amount for a Caribbean Stud poker hand having a value of a full house, twenty five times the additional amount for a Caribbean Stud poker hand having a value of four of a kind, one hundred times the additional amount for a Caribbean Stud poker hand having the value of a straight flush and two hundred and fifty times the additional amount for a Caribbean Stud poker hand having the value of a Royal Flush.

6. The method of claim 3 wherein the Caribbean Stud poker player's bonus payout is in accordance with the following Caribbean Stud poker bonus payout schedule: two times the additional amount for a Caribbean Stud poker hand having a value of two pair, four times the additional amount for a Caribbean Stud poker hand having a value of three of a kind, five times the additional amount for a Caribbean Stud poker hand having a value of a straight, seven times the additional amount for a Caribbean Stud poker hand having a value of a flush, ten times the additional amount for a Caribbean Stud poker hand having a value of a full house, twenty five times the additional amount for a Caribbean Stud poker hand having a value of four of a kind, one hundred times the additional amount for a Caribbean Stud poker hand having the value of a straight flush and two hundred and fifty times the additional amount for a Caribbean Stud poker hand having the value of a Royal Flush.

7. The method of claim 1 including the step of paying the Caribbean Stud poker player making the additional bet a sum equal to the additional bet if the Caribbean Stud poker player receives a five card Caribbean Stud poker hand equal to an Ace and King up to and including a single pair, including also providing every Caribbean Stud poker player playing against the Caribbean Stud poker dealer an opportunity to bet one dollar to be eligible for a Caribbean Stud poker progressive bonus jackpot payout prior to receiving any cards from the Caribbean Stud poker dealer, the Caribbean Stud poker player's bonus payout is in accordance with the following Caribbean Stud poker bonus payout schedule: two times the additional amount for a Caribbean Stud poker hand having a value of two pair, four times the additional amount for a Caribbean Stud poker hand having a value of three of a kind, five times the additional amount for a Caribbean Stud poker hand having a value of a straight, seven times the additional amount for a Caribbean Stud poker hand having a value of a flush, ten times the additional amount for a Caribbean Stud poker hand having a value of a fill house, twenty five times the additional amount for a Caribbean Stud poker hand having a value of four of a kind, one hundred times the additional amount for a Caribbean Stud poker hand having the value of a straight flush and two hundred and fifty times the additional amount for a Caribbean Stud poker hand having the value of a Royal Flush.

* * * * *